US010060305B2

(12) United States Patent
Toda et al.

(10) Patent No.: US 10,060,305 B2
(45) Date of Patent: Aug. 28, 2018

(54) VARIABLE VALVE TIMING APPARATUS

(71) Applicants: DENSO CORPORATION, Kariya, Aichi-pref. (JP); NIPPON SOKEN, INC., Nishio, Aichi-pref. (JP); TOYOTA JIDOSHA KABUSHIKI KAISHA, Toyota-shi, Aichi-ken (JP)

(72) Inventors: Shota Toda, Nishio (JP); Shuhei Oe, Nishio (JP); Toshiki Fujiyoshi, Kariya (JP); Haruhito Fujimura, Nagakute (JP); Yu Yokoyama, Okazaki (JP)

(73) Assignees: DENSO CORPORATION, Kariya (JP); NIPPON SOKEN, INC., Nishio (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 115 days.

(21) Appl. No.: 15/334,583

(22) Filed: Oct. 26, 2016

(65) Prior Publication Data

US 2017/0122140 A1 May 4, 2017

(30) Foreign Application Priority Data

Oct. 29, 2015 (JP) ..... 2015-213134

(51) Int. Cl.

| | |
|---|---|
| ***F01L 1/344*** | (2006.01) |
| *F01L 1/356* | (2006.01) |
| *F02D 13/02* | (2006.01) |

(52) U.S. Cl.

CPC ..... *F01L 1/3442* (2013.01); *F01L 1/356* (2013.01); *F01L 2001/3443* (2013.01); *F01L 2001/34436* (2013.01); *F01L 2001/34443* (2013.01); *F01L 2001/34486* (2013.01); *F01L 2201/00* (2013.01); *F01L 2800/14* (2013.01); *F01L 2820/041* (2013.01); *F02D 13/0203* (2013.01)

(58) Field of Classification Search

CPC ..... F01L 2001/3443; F01L 1/356; F01L 2201/00; F01L 2800/14; F01L 2820/041

USPC ..... 123/90.15, 90.17

See application file for complete search history.

(56) References Cited

U.S. PATENT DOCUMENTS

| | | | | |
|---|---|---|---|---|
| 6,885,976 B2 * | 4/2005 | Yoshiki | F01L 1/34 | 123/90.15 |
| 2014/0060469 A1 * | 3/2014 | Kobayashi | F01L 1/3442 | 123/90.15 |
| 2016/0017767 A1 * | 1/2016 | Nunami | F01L 1/3442 | 123/90.12 |

FOREIGN PATENT DOCUMENTS

| | | |
|---|---|---|
| JP | 2001-234768 | 8/2001 |

* cited by examiner

*Primary Examiner* — Jorge Leon, Jr.
(74) *Attorney, Agent, or Firm* — Nixon & Vanderhye P.C.

(57) ABSTRACT

A control device has two modes as control modes of an electric power supply to an electromagnetic solenoid, which are used when a first determining unit determines that a difference between a sensed value of a phase and a target value of the phase exceeds a permissible range. One of the modes is a special mode that is used when a second determining unit determines that the sensed value of the phase reaches a threshold value. Another one of the modes is a normal mode that is used when the second determining unit determines that the sensed value of the phase does not reach the threshold value. In the special mode, the control device controls supply of the electric power to the electromagnetic solenoid in such a manner that an opening degree of an advancing port is larger than the opening degree of the advancing port in the normal mode.

16 Claims, 15 Drawing Sheets

VARIABLE VALVE TIMING APPARATUS

CROSS REFERENCE TO RELATED APPLICATION

This application is based on and incorporates herein by reference Japanese Patent Application No. 2015-213134 filed on Oct. 29, 2015.

TECHNICAL FIELD

The present disclosure relates to a variable valve timing apparatus that advances or retards opening timing and closing timing of an intake valve or an exhaust valve of an internal combustion engine.

BACKGROUND

Previously, there is known a variable valve timing apparatus, which advances or retards opening timing and closing timing of an intake valve or an exhaust valve of an internal combustion engine through use of an oil pressure.

This type of variable valve timing apparatus includes a variable timing device, an oil pressure supply device, a phase sensing device, and a control device, which will be described hereinafter.

The variable timing device rotates vanes toward an advancing side or a retarding side through use of the oil pressure to advance or retard the opening timing and closing timing of the valve.

The oil pressure supply device includes a supply port, a valve element and an electromagnetic solenoid. The oil pressure is supplied to the variable timing device through the supply port. The valve element increase or decreases an opening degree of the supply port. The electromagnetic solenoid drives the valve element. The electric power supply to the electromagnetic solenoid is controlled to increase or decrease the opening degree of the supply port to adjust the supply of the oil pressure.

The phase sensing device senses a phase, which indicates a degree of advancing or a degree of retarding of the opening timing and closing timing of the intake valve or the exhaust valve.

The control device computes a target value of the phase based on an operational state of the internal combustion engine and controls the electric power supply to the electromagnetic solenoid based on a result of comparison between a sensed value of the phase, which is obtained from the phase sensing device, and the target value of the phase.

There would be a case where foreign objects, such as metal particles, are contained in the oil. Therefore, for example, at the time of closing the supply port, the foreign object may possibly be introduced into and caught in a gap between the supply port and the valve element to disable complete closing of the supply port with the valve element. In such a case, the oil pressure is continuously supplied to the variable timing device, and thereby a difference between the target value of the phase and the sensed value of the phase is disadvantageously increased.

In view of the above point, there is a known technique of that the supply port is opened for a small amount, which does not have a substantial influence on the operation of the internal combustion engine, so that the foreign object is removed from the gap.

However, there is a possibility of that the small opening degree does not allow removal of the foreign object.

Thus, it is conceivable to increase the opening degree of the supply port to an extent that allows reliable removal of the foreign object.

However, when the opening degree of the supply port is increased, the oil pressure is rapidly supplied to the variable timing device. Therefore, the phase is changed within a short period of time to possibly increase a possibility of an unexpected sudden increase in a rotational speed of the internal combustion engine.

Therefore, it is desirable to have a structure that can reliably remove the foreign object while limiting the unexpected sudden increase in the rotational speed of the internal combustion engine.

JP2001-234768A discloses a structure that can limit occurrence of the unexpected sudden increase in the rotational speed of the internal combustion engine even when the opening degree of the supply port is increased for the purpose of removing the foreign object.

Specifically, in the variable valve timing apparatus of JP2001-234768A, a lock pin is engaged with a vane to limit a change in the phase. The engagement of the lock pin is controlled by supplying the oil pressure from a separate oil pressure supply device, which is different from the oil pressure supply device that supplies the oil pressure to the variable timing device.

Therefore, in the variable valve timing apparatus of JP2001-234768A, the opening degree of the supply port can be increased while limiting the change in the phase even during the operation of the internal combustion engine. Thus, the foreign object can be reliably removed while limiting the unexpected sudden increase in the rotational speed of the internal combustion engine.

However, the variable valve timing apparatus of JP2001-234768A additionally requires the lock pin and the oil pressure supply device for the lock pin. Furthermore, a control mode for controlling the oil pressure supply device is required. Therefore, the structure of the variable valve timing apparatus becomes complicated.

SUMMARY

The present disclosure is made in view of the above disadvantages.

According to the present disclosure, there is provided a variable valve timing apparatus that advances or retards opening timing and closing timing of an intake valve of an internal combustion engine through use of an oil pressure. The variable valve timing apparatus includes a variable timing device, an oil pressure supply device, a phase sensing device and a control device. The variable timing device rotates a vane toward an advancing side through application of the oil pressure to the vane to advance the opening timing and closing timing of the intake valve. The oil pressure supply device includes a supply port, a valve element and an electromagnetic solenoid. The supply port supplies the oil pressure to the variable timing device. The valve element increases or decreases an opening degree of the supply port. The electromagnetic solenoid drives the valve element. The opening degree of the supply port is increased or decreased by the valve element to adjust supply of the oil pressure to the variable timing device when supply of an electric power to the electromagnetic solenoid is controlled. The phase sensing device senses a phase, which indicates a degree of advancing of the opening timing and closing timing. The control device computes a target value of the phase based on an operational state of the internal combustion engine and controls the supply of the electric power to the electromagnetic solenoid based a result of comparison between a sensed value of the phase, which is obtained from the phase sensing device, and the target value of the phase. The variable timing device includes a limiting portion that limits rotation of the vane toward the advancing side and thereby defines a limit of a variable range of the phase at a most advanced side. The control device sets: a permissible range of a difference between the sensed value of the phase and the target value of the phase; and a threshold value of the sensed value of the phase. The control device includes a first determining unit and a second determining unit. The first determining unit determines whether the difference exceeds the permissible range. The second determining unit determines whether the sensed value of the phase reaches the threshold value when the first determining unit determines that the difference exceeds the permissible range. The control device has at least two modes as control modes of the electric power supply to the electromagnetic solenoid, which are used when the first determining unit determines that the difference exceeds the permissible range. One of the two modes is a special mode that is used when the second determining unit determines that the sensed value of the phase reaches the threshold value. Another one of the two modes is a normal mode that is used when the second determining unit determines that the sensed value of the phase does not reach the threshold value. In the special mode, the control device controls the supply of the electric power to the electromagnetic solenoid in such a manner that the opening degree of the supply port is larger than the opening degree of the supply port in the normal mode.

According to the present disclosure, there is also provided a variable valve timing apparatus that advances or retards opening timing and closing timing of an exhaust valve of an internal combustion engine through use of an oil pressure. The variable valve timing apparatus includes a variable timing device, an oil pressure supply device, a phase sensing device and a control device. The variable timing device rotates a vane toward a retarding side through application of the oil pressure to the vane to retard the opening timing and closing timing of the exhaust valve. The oil pressure supply device includes a supply port, a valve element, and an electromagnetic solenoid. The supply port supplies the oil pressure to the variable timing device. The valve element increases or decreases an opening degree of the supply port. The electromagnetic solenoid drives the valve element. The opening degree of the supply port is increased or decreased by the valve element to adjust supply of the oil pressure to the variable timing device when supply of an electric power to the electromagnetic solenoid is controlled. The phase sensing device senses a phase, which indicates a degree of retarding of the opening timing and closing timing. The control device computes a target value of the phase based on an operational state of the internal combustion engine and controls the supply of the electric power to the electromagnetic solenoid based a result of comparison between a sensed value of the phase, which is obtained from the phase sensing device, and the target value of the phase. The variable timing device includes a limiting portion that limits rotation of the vane toward the retarding side and thereby defines a limit of a variable range of the phase at a most retarded side. The control device sets: a permissible range of a difference between the sensed value of the phase and the target value of the phase; and a threshold value of the sensed value of the phase. The control device includes a third determining unit and a fourth determining unit. The third determining unit determines whether the difference exceeds the permissible range. The fourth determining unit determines whether the sensed value of the phase reaches the threshold value when the third determining unit determines that the difference exceeds the permissible range. The control device has at least two modes as control modes of the electric power supply to the electromagnetic solenoid, which are used when the third determining unit determines that the difference exceeds the permissible range. One of the two modes is a special mode that is used when the fourth determining unit determines that the sensed value of the phase reaches the threshold value. Another one of the two modes is a normal mode that is used when the fourth determining unit determines that the sensed value of the phase does not reach the threshold value. In the special mode, the control device controls the supply of the electric power to the electromagnetic solenoid in such a manner that the opening degree of the supply port is larger than the opening degree of the supply port in the normal mode.

BRIEF DESCRIPTION OF THE DRAWINGS

The drawings described herein are for illustration purposes only and are not intended to limit the scope of the present disclosure in any way.

DETAILED DESCRIPTION

Hereinafter, an embodiment of the present disclosure will be described.

A variable valve timing apparatus of the present embodiment will be described with reference to FIGS. 1 to 4C and 8 to 10C.

The variable valve timing apparatus (hereinafter also referred to as a variable apparatus) 1 advances or retards opening timing and closing timing of intake valves (not shown) and exhaust valves (not shown) of an internal combustion engine through use of an oil pressure.

Specifically, the variable apparatus 1 includes a variable timing device 3A, an oil pressure supply device 5A, a phase sensing device 7A, and an ECU (serving as a control device) 9 as components of a system (hereinafter referred to as an intake valve system), which is involved in control of opening timing and closing timing of the intake valves. Furthermore, the variable apparatus 1 includes a variable timing device 3B, an oil pressure supply device 5B, a phase sensing device 7B, and the ECU 9 as components of a system (hereinafter referred to as an exhaust valve system), which is involved in control of opening timing and closing timing of the exhaust valves. The ECU 9 is commonly used by both of the intake valve system and the exhaust valve system.

With the above structure, the variable apparatus 1 changes a phase θA and a phase θB. The phase θA indicates a degree of advancing or retarding of the opening timing and closing timing of the intake valves. The phase θB indicates a degree of advancing or retarding of the opening timing and closing timing of the exhaust valves.

Hereinafter, the intake valve system of the variable apparatus 1 will be first described, and then the exhaust valve system of the variable apparatus 1 will be described.

As described above, the variable apparatus 1 includes the variable timing device 3A, the oil pressure supply device 5A, the phase sensing device 7A and the ECU 9 as the constituent components of the intake valve system.

Figure 2:
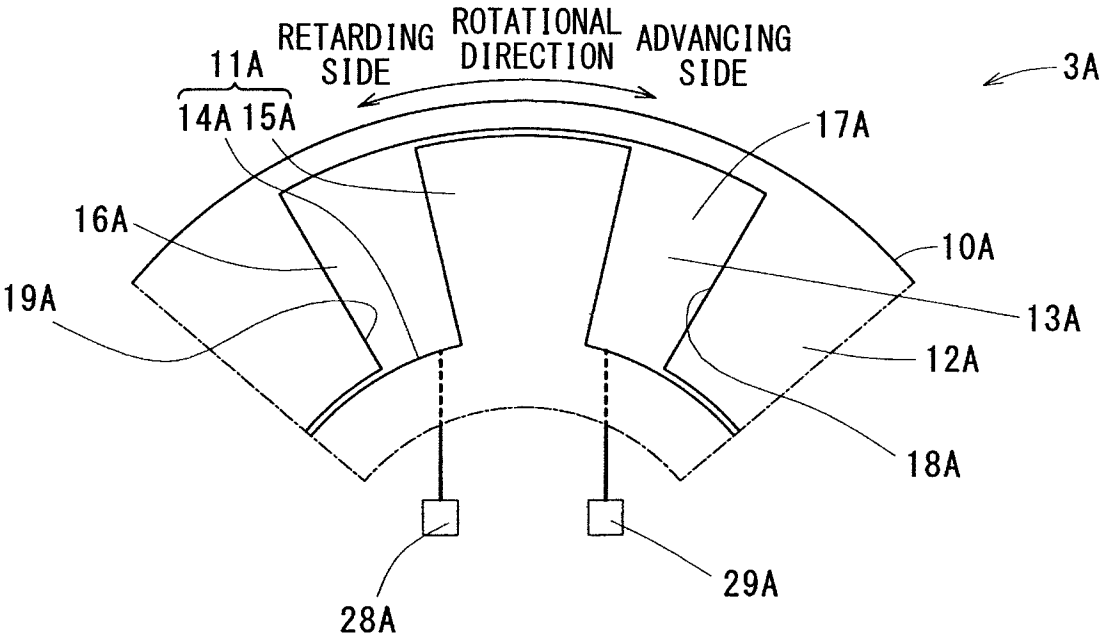
FIG. 2 is a descriptive diagram of a variable timing device of an intake valve system of the embodiment.

As shown in FIG. 2, the variable timing device 3A includes a housing 10A and a rotor 11A. The housing 10A is rotated when a drive force is transmitted from a crankshaft (not shown) of the engine to the housing 10A. The rotor 11A is received in an inside of the housing 10A and is joined to a camshaft (not shown), which controls opening and closing of the intake valves.

When the drive force is transmitted from the crankshaft to the housing 10A, the housing 10A is rotated synchronously with the crankshaft in an advancing direction shown in FIG. 2. The housing 10A is shaped into a tubular form and includes a plurality of partitions 12A, which radially inwardly project and are arranged one after another at generally equal intervals in a circumferential direction, and a receiving chamber 13A, which is shaped into a fan form, is defined between each circumferentially adjacent two of the partitions 12A.

The rotor 11A includes a boss 14A and a plurality of vanes (also referred to as rotatable vanes) 15A. The boss 14A is fixed to the camshaft, which drives the intake valves. The vanes 15A radially outwardly project from the boss 14A and are arranged one after another in the circumferential direction. Each of the vanes 15A is inserted into a corresponding one of the receiving chambers 13A to fluid-tightly partition the receiving chamber 13A into an advancing chamber 16A and a retarding chamber 17A.

When the oil pressure is supplied to the advancing chambers 16A, the vanes 15A are rotated in the advancing direction (advancing side) to advance the opening timing and closing timing of the intake valves. In contrast, when the oil pressure is supplied to the retarding chambers 17A, the vanes 15A are rotated in the retarding direction (retarding side) to retard the opening timing and closing timing of the intake valves.

Furthermore, the variable timing device 3A includes an advancing side limiting portion 18A and a retarding side limiting portion 19A, which are provided at two opposite circumferential ends, respectively, of each receiving chamber 13A at the housing 10A. The advancing side limiting portion 18A limits the rotation of the corresponding vane 15A toward the advancing side and thereby defines a limit of the variable range of the phase θA at the most advanced side. The retarding side limiting portion 19A limits the rotation of the corresponding vane 15A toward the retarding side and thereby defines another limit of the variable range of the phase θA at the most retarded side.

Here, the advancing side limiting portion 18A is a boundary wall of the receiving chamber 13A at the advancing side. When the vane 15A abuts against the advancing side limiting portion 18A, the rotation of the vane 15A toward the advancing side is limited, i.e., is stopped.

Similarly, the retarding side limiting portion 19A is a boundary wall of the receiving chamber 13A at the retarding side. When the vane 15A abuts against the retarding side limiting portion 19A, the rotation of the vane 15A toward the retarding side is limited, i.e., is stopped.

Figure 1:
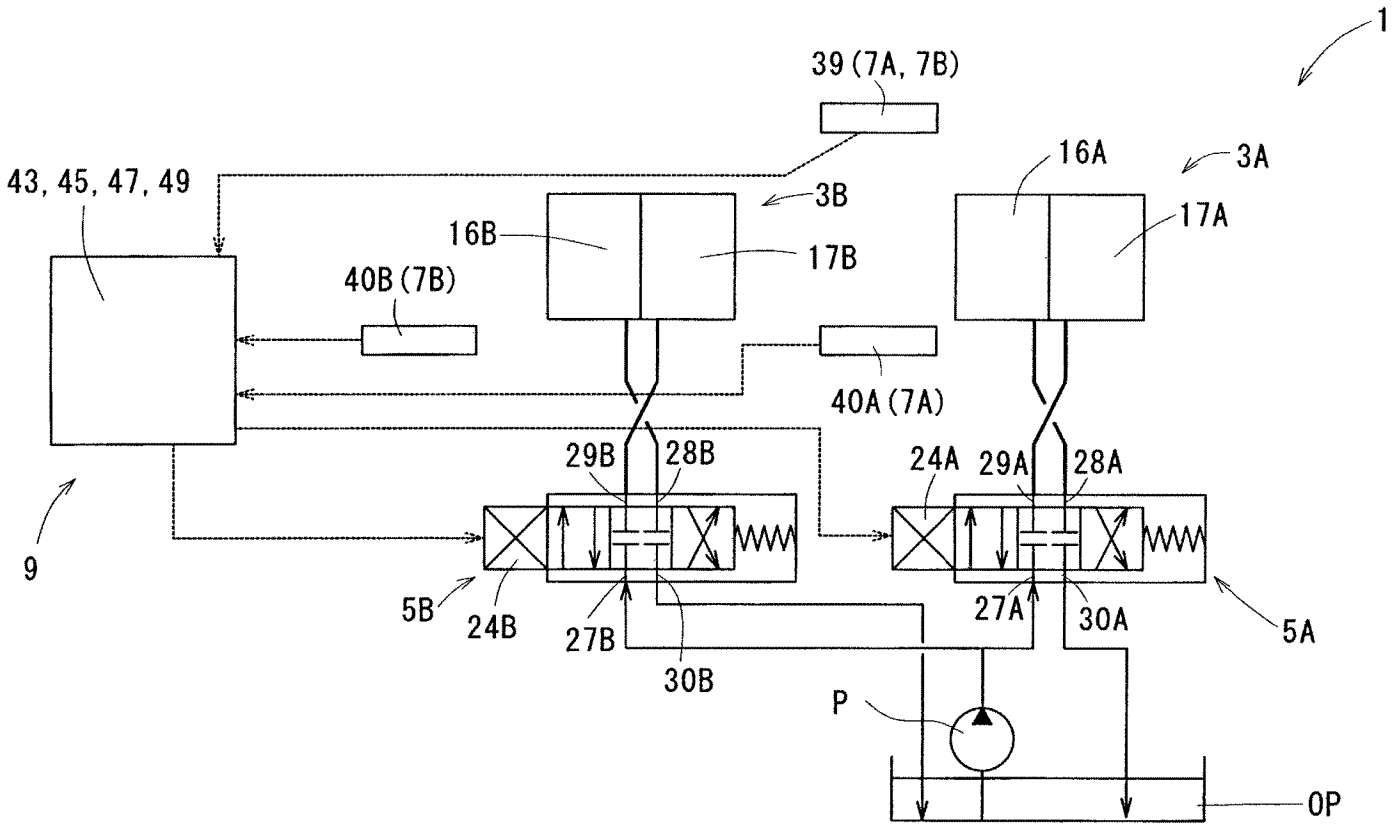
FIG. 1 is a descriptive diagram of a variable valve timing apparatus according to an embodiment of the present disclosure.
Figure 3:
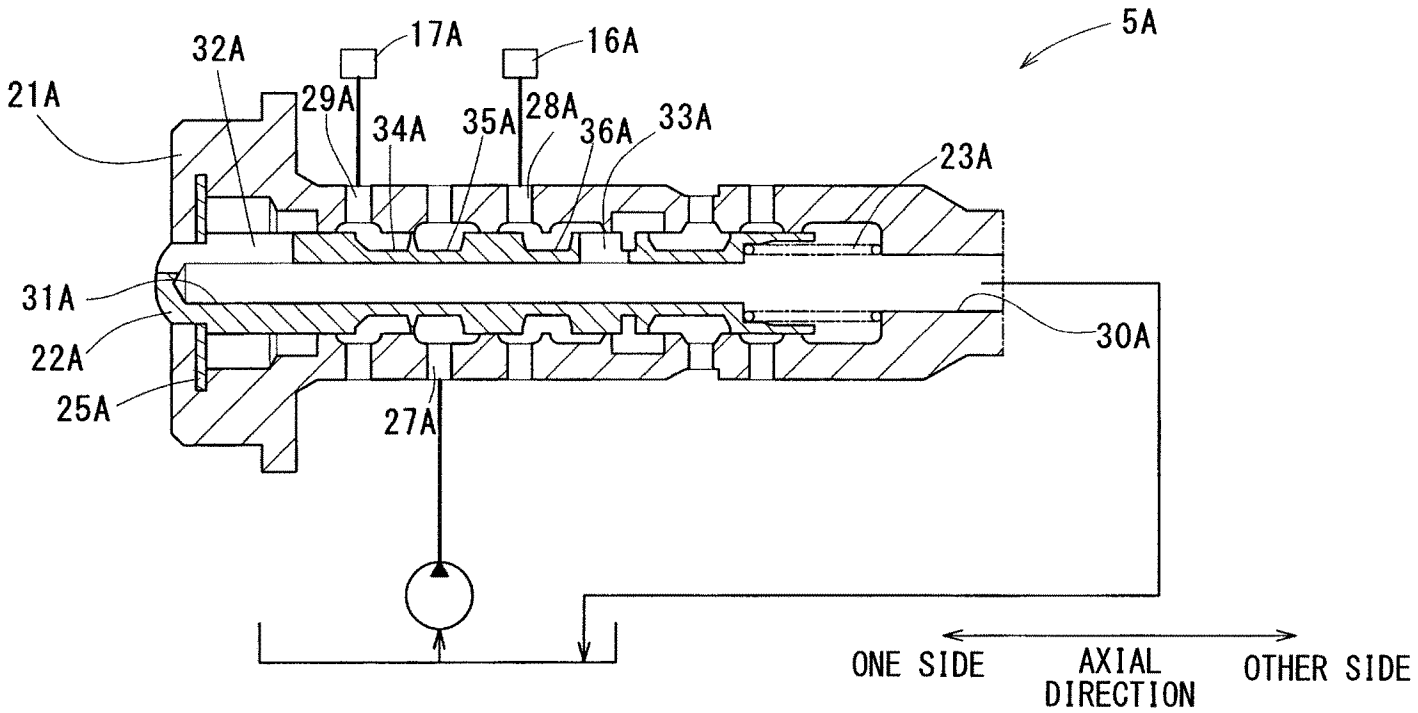
FIG. 3 is a descriptive diagram of an oil pressure supply device of the intake valve system of the embodiment.

As shown in FIG. 3, the oil pressure supply device 5A is an electromagnetic spool valve, which includes a sleeve 21A, a spool 22A, a return spring 23A and an electromagnetic solenoid 24A (see FIG. 1).

Hereinafter, for the descriptive purpose, the left side of the spool 22A where one end part of the spool 22A is placed in the axial direction in FIG. 3 will be referred to as one side, and the right side of the spool 22A where the other end part of the spool 22A is placed in the axial direction in FIG. 3 will be referred to as the other side. The return spring 23A is held between the sleeve 21A and the other end part of the spool 22A. The return spring 23A urges the spool 22A toward the one side in the axial direction. When the electric power is not supplied to a coil of the electromagnetic solenoid 24A, the spool 22A is urged by the urging force of the return spring 23A against a stopper 25A, which is held by the sleeve 21A at the one side. When the electric power is supplied to the coil of the electromagnetic solenoid 24A, the electromagnetic solenoid 24A generates a magnetic attractive force to drive the spool 22A toward the other side against the urging force of the return spring 23A.

The sleeve 21A is shaped into, for example, a tubular body that receives the spool 22A such that the spool 22A is slidable in the axial direction along an inner peripheral portion of the sleeve 21A. Furthermore, the sleeve 21A includes an inlet port 27A, an advancing port 28A, a retarding port 29A and a drain port 30A. The inlet port 27A is connected to a discharge outlet of an oil pump (also referred to as an oil pressure pump) P. The advancing portion 28A is connected to the advancing chambers 16A. The retarding port 29A is connected to the retarding chambers 17A. The drain port 30A is connected to a drain (oil pan OP). The drain port 30A is in a form of, for example, a through hole that extends in the axial direction through a wall of the other end part of the sleeve 21A located on the other side. The oil pump P is, for example, a mechanical pump that is driven by the crankshaft. During the time of operating the internal combustion engine, the oil pump P suctions the oil from the oil pan OP and supplies the suctioned oil to the inlet port 27A.

The inlet port 27A, the advancing port 28A, the retarding port 29A and the drain port 30A may be simply referred to as ports 27A, 28A, 29A, 30A unless it is necessary to individually specify these ports 27A, 28A, 29A, 30A.

The spool 22A is a valve element that changes a communication state between corresponding ones of the ports 27A, 28A, 29A, 30A. The spool 22A includes a hollow space 31A, hollow space openings 32A, 33A, and circumferential grooves 34A, 35A, 36A.

An axis of the hollow space 31A is coaxial with an axis of the spool 22A. The hollow space 31A opens to the inner peripheral portion of the sleeve 21A at the other end part of the spool 22A and is always communicated with the drain port 30A.

The hollow space openings 32A, 33A are respectively located on the one side and the other side of the circumferential grooves 34A-36A in the axial direction and open the hollow space 31A to an outer peripheral surface of the spool 22A.

Figure 4A:
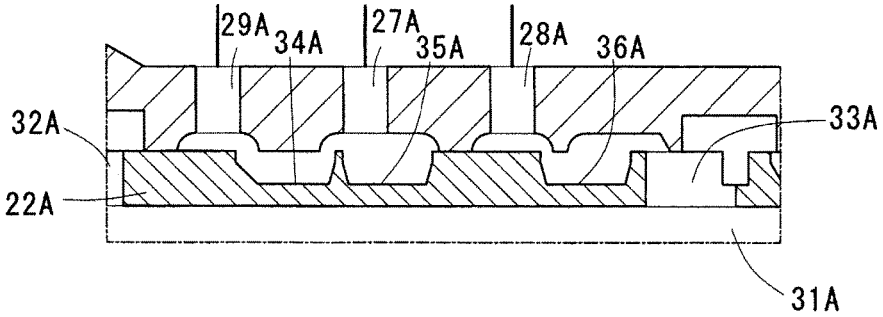
FIGS. 4A to 4C are diagrams showing various operational states of a spool of the intake valve system of the embodiment.
Figure 4B:
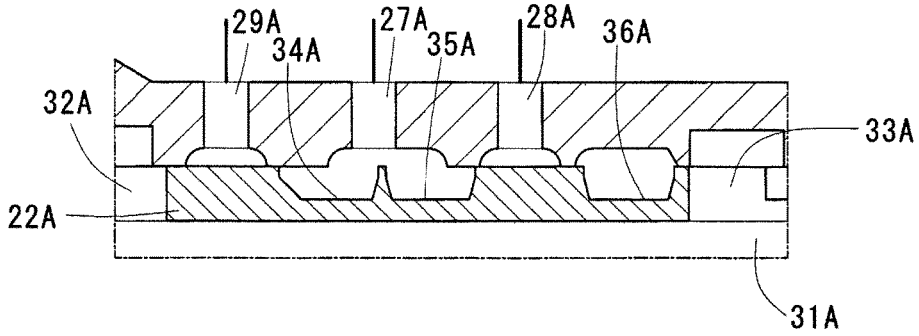
Figure 4C:
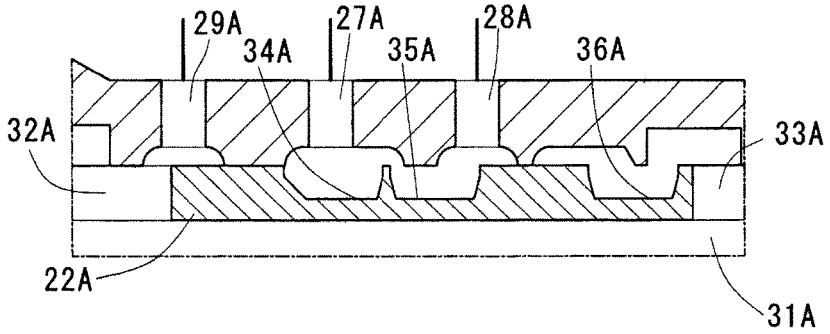

Furthermore, the hollow space opening 32A is communicatable with the retarding port 29A to communicate between the retarding port 29A and the drain port 30A through the hollow space 31A (see FIG. 4C).

The hollow space opening 33A is communicatable with the advancing port 28A to communicate between the advancing port 28A and the drain port 30A through the hollow space 31A (see FIG. 4A).

The circumferential grooves 34A-36A are arranged between the hollow space opening 32A and the hollow space opening 33A in the order of the circumferential groove 34A, the circumferential groove 35A and the circumferential groove 36A from the one side toward the other side in the axial direction.

The circumferential groove 34A can communicate between the inlet port 27A and the retarding port 29A (see FIG. 4A), and the circumferential groove 34A can also communicate between the inlet port 27A and the advancing port 28A (see FIG. 4C).

The circumferential groove 36A can communicate between the advancing port 28A and the drain port 30A through the hollow space 31A and the hollow space opening 33A (see FIG. 4A).

Hereinafter, the operation of the oil pressure supply device 5A will be described. When the electric power supply to the electromagnetic solenoid 24A starts, the spool 22A starts its movement. Thereby, the spool 22A is lifted away from the stopper 25A and is moved toward the other side (the right side in FIG. 3) in the axial direction. When the amount ISA of electric power supplied to the electromagnetic solenoid 24A is increased, the retarding port 29A is first communicated with the inlet port 27A, and the advancing port 28A is communicated with the drain port 30A (see FIG. 4A). In this state, the oil is supplied to the retarding chambers 17A, and the oil is drained from the advancing chambers 16A. Therefore, the rotor 11A is rotated relative to the housing 10A toward the retarding side, and thereby the phase 8A is changed to the retarding side.

Hereinafter, the state of communicating the retarding port 29A to the inlet port 27A and communicating the advancing port 28A to the drain port 30A will be referred to as a retarding operational state.

When the amount ISA of electric power supplied to the electromagnetic solenoid 24A is continuously increased, both of the advancing port 28A and the retarding port 29A are not communicated with any of the inlet port 27A and the drain port 30A (see FIG. 4B). In this state, the inflow and the outflow of the oil relative to the advancing chambers 16A and the retarding chambers 17A are both blocked, i.e., stopped. Therefore, the rotor 11A is no longer rotated relative to the housing 10A, and thereby the current phase 8A is held.

Hereinafter, the state of blocking the communication of the advancing port 28A and the retarding port 29A to both of the inlet port 27A and the drain port 30A will be referred to as a holding operational state.

When the amount ISA of electric power supplied to the electromagnetic solenoid 24A is further continuously increased, the advancing port 28A is communicated with the inlet port 27A, and the retarding port 29A is communicated with the drain port 30A (see FIG. 4C). In this state, the oil is supplied to the advancing chambers 16A, and the oil is drained from the retarding chambers 17A. Therefore, the rotor 11A is rotated relative to the housing 10A toward the advancing side, and thereby the phase θA is changed to the advancing side.

Hereinafter, the state of communicating the advancing port 28A to the inlet port 27A and communicating the retarding port 29A to the drain port 30A will be referred to as an advancing operational state.

Thereby, in the oil pressure supply device 5A, the state of communication of the ports 20A-30A is changed among the retarding operational state, the holding operational state, and the advancing operational state depending of the amount ISA of electric power supplied to the electromagnetic solenoid 24A.

The phase sensing device 7A senses the phase 8A of the intake valves.

More specifically, as shown in FIG. 1, the phase sensing device 7A includes a crank angle sensor 39 and a cam angle sensor 40A. The crank angle sensor 39 senses a rotational angle of the crankshaft. The cam angle sensor 40A senses a rotational angle of the camshaft, which drives the intake valves.

The ECU 9 computes the phase θA based on the sensed values of these sensors 39, 40A and uses this computed phase 8A as a sensed value of the phase θA.

The ECU 9 computes a target value of the phase θA according to the operational state of the internal combustion engine and controls the electric power supply to the electromagnetic solenoid 24A in a manner that coincides the sensed value of the phase θA to the target value of the phase θA.

That is, in a case where the target value of the phase θA is on the advancing side of the sensed value of the phase θA, the ECU 9 controls the amount ISA of electric power supplied to the electromagnetic solenoid 24A in a manner that implements the advancing operational state in the oil pressure supply device 5A, so that the sensed value of the phase θA is changed to the advancing side. In contrast, in a case where the target value of the phase θA is on the retarding side of the sensed value of the phase θA, the ECU 9 controls the amount ISA of electric power supplied to the electromagnetic solenoid 24A in a manner that implements the retarding operational state in the oil pressure supply device 5A, so that the sensed value of the phase θA is changed to the retarding side.

Next, the exhaust valve system of the variable apparatus 1 will be described. Similar to the intake valve system discussed above, the variable apparatus 1 includes the variable timing device 3B, the oil pressure supply device 5B, the phase sensing device 7B and the ECU 9 as components of the exhaust valve system.

The structures of the variable timing device 3B and the oil pressure supply device 5B are the same as the structures of the variable timing device 3A and the oil pressure supply device 5A, respectively, and thereby will not be described for the sake of simplicity (see FIGS. 8 to 10C). In the following discussion, the reference signs of the components of the variable timing device 3B will be distinguished from the reference signs of the equivalent components of the variable timing device 3A by changing the alphabet at the last end of each corresponding reference sign from A to B. Similarly, the reference signs of the components of the oil pressure supply device 5B will be distinguished from the reference signs of the equivalent components of the oil pressure supply device 5A by changing the alphabet at the last end of each corresponding reference sign from A to B.

Furthermore, the phase sensing device 7B senses the phase θB of the exhaust valves and includes the crank angle sensor 39 and a cam angle sensor 40B. The crank angle sensor 39 is commonly used by the intake valve system and the exhaust valve system. The cam angle sensor 40B senses a rotational angle of a camshaft, which drives the exhaust valves. The ECU 9 computes the phase θB based on the sensed values of these sensors 39, 40B and uses this computed phase θB as a sensed value of the phase θB. In the exhaust valve system, the ECU 9 controls the phase θB through the oil pressure supply device 5B. This control of the phase θB is similar to the control of the phase θA through the oil pressure supply device 5A.

The characteristics of the intake valve system will be first described, and thereafter the characteristics of the exhaust valve system will be described.

Figure 5A:
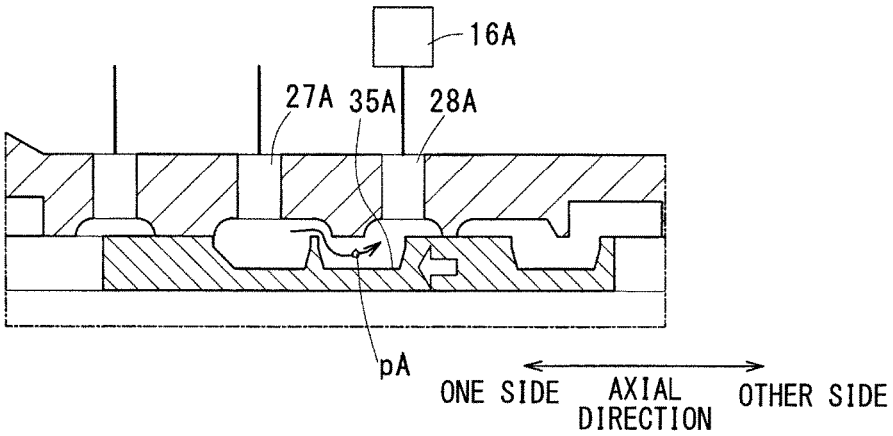
FIGS. 5A and 5B are descriptive diagrams for describing biting of a foreign object in the intake valve system of the embodiment.
Figure 5B:
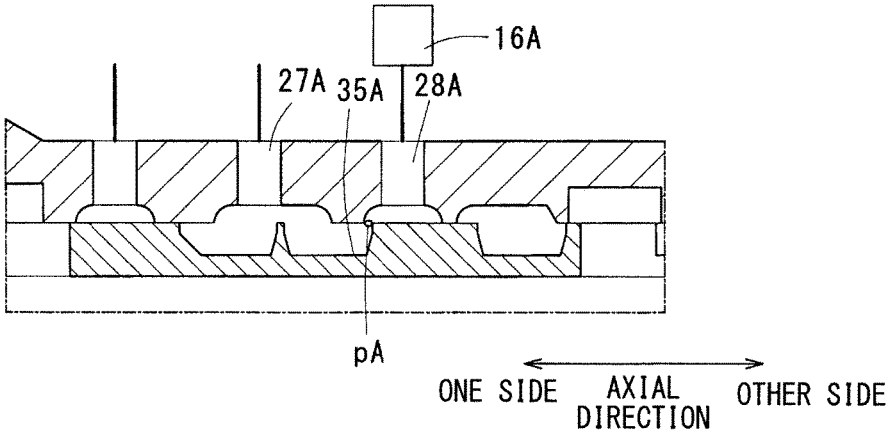

Now, the characteristics of the intake valve system will be first described. The following discussion of the characteristics of the intake valve system is under the assumption of that a foreign object pA, such as debris, is bitten, i.e., clamped between the spool 22A and the sleeve 21A in the oil pressure supply device 5A at the time of changing the operational state of the oil pressure supply device 5A from the advancing operational state to the holding operational state, so that the communication between the advancing port 28A and the inlet port 27A cannot be completely blocked. In this case, it is assumed that the biting of the foreign object pA occurs between, for example, a wall of the circumferential groove 35A, which is located on the other side in the axial direction, and a wall of a radially inner opening of the advancing port 28A, which is located on the one side in the axial direction (see FIGS. 5A and 5B). Specifically, in the case of FIGS. 5A and 5B, the foreign object pA is introduced into the circumferential groove 35A from the inlet port 27A (see FIG. 5A). When the spool 22A is moved toward the one side in the axial direction (see a blank arrow in FIG. 5A), the foreign object pA is clamped between the wall of the circumferential groove 35A, which is located on the other side in the axial direction, and the wall of the radially inner opening of the advancing port 28A, which is located on the one side in the axial direction, as shown in FIG. 5B.

When this incidence occurs, the oil continuously flows into the advancing chambers 16A, so that the phase θA is continuously changed toward the advancing side beyond the target value.

Thus, the ECU 9 sets a permissible range εA and a threshold value θAc to address the biting of the foreign object pA in the oil pressure supply device 5A. Furthermore, the ECU 9 includes a first determining unit (also referred to as a primary determining unit) 43, which uses the permissible range εA, and a second determining unit (also referred to as a secondary determining unit) 45, which uses the threshold value θAc. Furthermore, in order to remove the foreign object, which is bitten between the spool 22A and the sleeve 21A, the ECU 9 has two operational modes, i.e., an intake side special mode and an intake side normal mode as operational modes for controlling the electric power supply to the electromagnetic solenoid 24A.

The permissible range εA is set for a difference (divergence) δA between the sensed value of the phase θA and the target value of the phase θA. The first determining unit 43 determines whether the difference δA exceeds the permissible range εA.

Furthermore, the threshold value θAc is set for the sensed value of the phase θA. When the first determining unit 43 determines that the difference δA exceeds the permissible range εA, the second determining unit 45 determines whether the sensed value of the phase θA has reached the threshold value θAc.

The intake side special mode and the intake side normal mode are the modes that are used at the time when the first determining unit 43 determines that the difference δA exceeds the permissible range εA. Furthermore, the intake side special mode is the mode that is used when the second determining unit 45 determines that the sensed value of the phase θA has reached the threshold value θAc. The intake side normal mode is the mode that is used when the second determining unit 45 determines that the sensed value of the phase θA has not reached the threshold value θAc.

In the intake side special mode, the power supply to the electromagnetic solenoid 24A is controlled such that an opening degree of the advancing port (serving as a supply port) 28A becomes larger than an opening degree of the advancing port 28A in the intake side normal mode.

Here, the opening degree of the advancing port 28A refers to a degree of communication between the advancing port 28A and the inlet port 27A. The opening degree of the advancing port 28A may be defined as a distance in the axial direction between the two walls (the wall of the circumferential groove 35A, which is located on the other side in the axial direction, and the wall of the radially inner opening of the advancing port 28A, which is located on the one side in the axial direction), which clamp the foreign object pA.

Furthermore, a difference between the opening degree of the advancing port 28A in the intake side special mode and the opening degree of the advancing port 28A in the intake side normal mode is set by, for example, changing a temporal change pattern of a command value for the amount ISA of electric power supplied to the electromagnetic solenoid 24A between the intake side special mode and the intake side normal mode. Specifically, in the present embodiment, the temporal change pattern in the intake side special mode is set to be a rectangular waveform, and the temporal change pattern in the intake side normal mode is set to be a triangular waveform. In this way, the opening degree in the intake side special mode becomes larger than the opening degree in the intake side normal mode. Specifically, by implementing the intake side special mode with the rectangular waveform and the intake side normal mode with the triangular waveform, a temporal average value of the opening degree in the intake side special mode becomes larger than a temporal average value of the opening degree in the intake side normal mode.

Furthermore, the threshold value θAc is set as a value of the phase θA at the time of abutting the vane 15A against the advancing side limiting portion 18A. Specifically, with reference to FIG. 2, the threshold value θAc is a boundary value of the variable range of the phase θA at the most advanced side (most advanced phase value θAL).

Figure 11A:
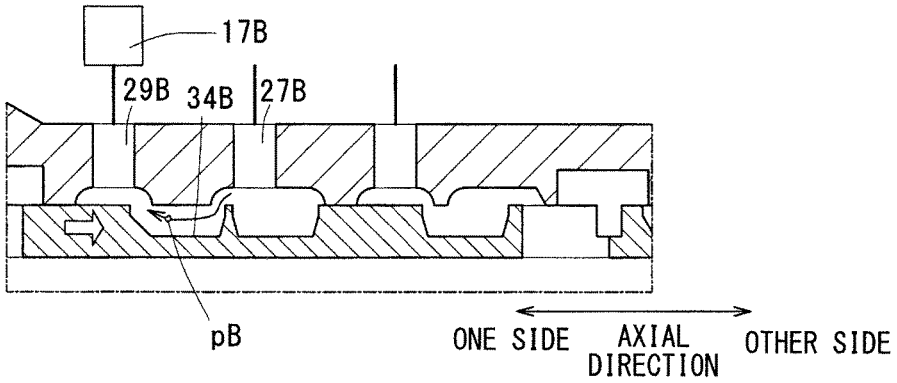
FIGS. 11A and 11B are descriptive diagrams for describing biting of a foreign object in the exhaust valve system of the embodiment.
Figure 11B:
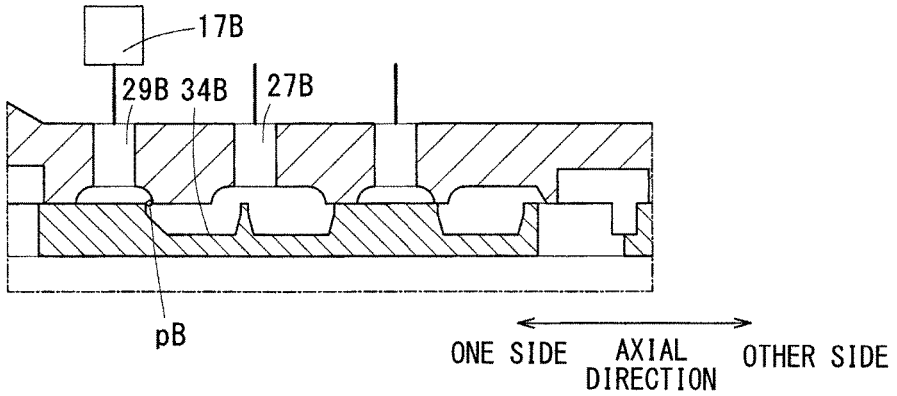

Next, the characteristics of the exhaust valve system will be described. The following discussion of the characteristics of the exhaust valve system is under the assumption of that the foreign object pB is bitten, i.e., clamped between the spool 22A and the sleeve 21A in the oil pressure supply device 5B at the time of changing the operational state of the oil pressure supply device 5B from the retarding operational state to the holding operational state, so that the communication between the retarding port 29B and the inlet port 27B cannot be completely blocked. In this case, it is assumed that the biting of the foreign object pB occurs between, for example, a wall of the circumferential groove 34B, which is located on the one side in the axial direction, and a wall of a radially inner opening of the retarding port 29B, which is located on the other side in the axial direction (see FIGS. 11A and 11B). Specifically, in the case of FIGS. 11A and 11B, the foreign object pB is introduced into the circumferential groove 34B from the inlet port 27B (see FIG. 11A). When the spool 22B is moved toward the other side in the axial direction (see a blank arrow in FIG. 11A), the foreign object pB is clamped between the wall of the circumferential groove 34B, which is located on the one side in the axial direction, and the wall of the radially inner opening of the retarding port 29B, which is located on the other side in the axial direction, as shown in FIG. 11B.

When this incidence occurs, the oil continuously flows into the retarding chambers 17B, so that the phase θB is continuously changed toward the retarding side beyond the target value. Thus, a permissible range εB and a threshold value θBc are set at the ECU 9 to counteract against the biting of the foreign object pB in the oil pressure supply device 5B. The ECU 9 includes a third determining unit (also referred to as a primary determining unit) 47, which uses the permissible range εB, and a fourth determining unit (also referred to as a secondary determining unit) 49, which uses the threshold value θBc. Furthermore, in order to remove the foreign object, which is bitten between the spool 22B and the sleeve 21B, the ECU 9 has two operational modes, i.e., an exhaust side special mode and an exhaust side normal mode as operational modes for controlling the electric power supply to the electromagnetic solenoid 24B.

The permissible range εB is set for a difference (divergence) δB between the sensed value of the phase θB and the target value of the phase θB. The third determining unit 47 determines whether the difference δB exceeds the permissible range εB.

Furthermore, the threshold value θBc is set for the sensed value of the phase OB. When the third determining unit 47 determines that the difference δB exceeds the permissible range εB, the fourth determining unit 49 determines whether the sensed value of the phase θB has reached the threshold value θBc.

The exhaust side special mode and the exhaust side normal mode are the modes that are used at the time when the third determining unit 47 determines that the difference δB exceeds the permissible range εB. Furthermore, the exhaust side special mode is the mode that is used when the fourth determining unit 49 determines that the sensed value of the phase θB has reached the threshold value θBc. The exhaust side normal mode is the mode that is used when the fourth determining unit 49 determines that the sensed value of the phase θB has not reached the threshold value θBc.

In the exhaust side special mode, the power supply to the electromagnetic solenoid 24B is controlled such that an opening degree of the retarding port (serving as a supply port) 29B becomes larger than an opening degree of the retarding port 29B in the exhaust side normal mode.

Here, the opening degree of the retarding port 29B refers to a degree of communication between the retarding port 29B and the inlet port 27B. The opening degree of the retarding port 29B may be defined as a distance in the axial direction between the two walls (the wall of the circumferential groove 34B, which is located on the one side in the axial direction, and the wall of the radially inner opening of the retarding port 29B, which is located on the other side in the axial direction), which clamp the foreign object pB.

Furthermore, a difference between the opening degree of the retarding port 29B in the exhaust side special mode and the opening degree of the retarding port 29B in the exhaust side normal mode is set by, for example, changing a temporal change pattern of a command value for the amount ISB of electric power supplied to the electromagnetic solenoid 24B between the exhaust side special mode and the exhaust side normal mode. Specifically, in the present embodiment, the temporal change pattern in the exhaust side special mode is set to be a rectangular waveform, and the temporal change pattern in the exhaust side normal mode is set to be a triangular waveform. In this way, the opening degree in the exhaust side special mode becomes larger than the opening degree in the exhaust side normal mode. Specifically, by implementing the exhaust side special mode with the rectangular waveform and the exhaust side normal mode with the triangular waveform, a temporal average value of the opening degree in the exhaust side special mode becomes larger than a temporal average value of the opening degree in the exhaust side normal mode. Furthermore, the threshold value θBc is set as a value of the phase θB at the time of abutting the vane 15B against the retarding side limiting portion 19B. Specifically, with reference to FIG. 8, the threshold value θBc is a boundary value of the variable range of the phase θB at the most retarded side (most retarded phase value θBL).

The control method for the intake valve system according to the present embodiment will be described with reference to FIGS. 6A to 7.

Figure 6A:
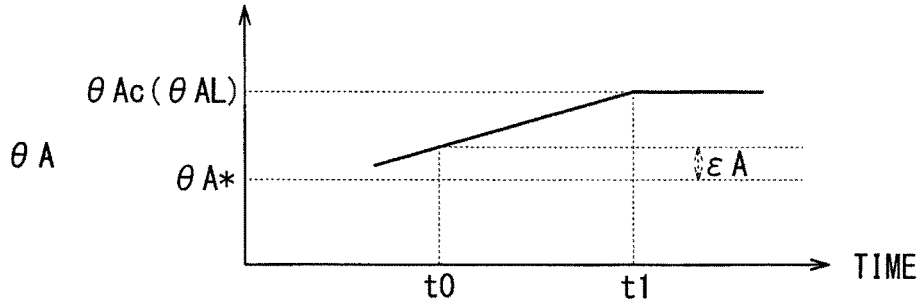
FIG. 6A is a diagram indicating a change in a phase with time in the intake valve system of the embodiment.
Figure 6B:
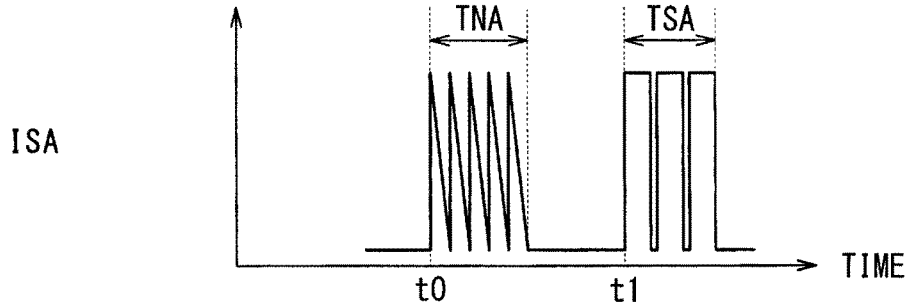
FIG. 6B is a diagram indicating a change in the amount of electric power supplied to an electromagnetic solenoid with time in the intake valve system of the embodiment.

In FIG. 6A, θA* is the target value of the phase θA. Furthermore, in FIG. 6B, TNA is an execution time period of the intake side normal mode, and TSA is an execution time period of the intake side special mode.

Figure 7:
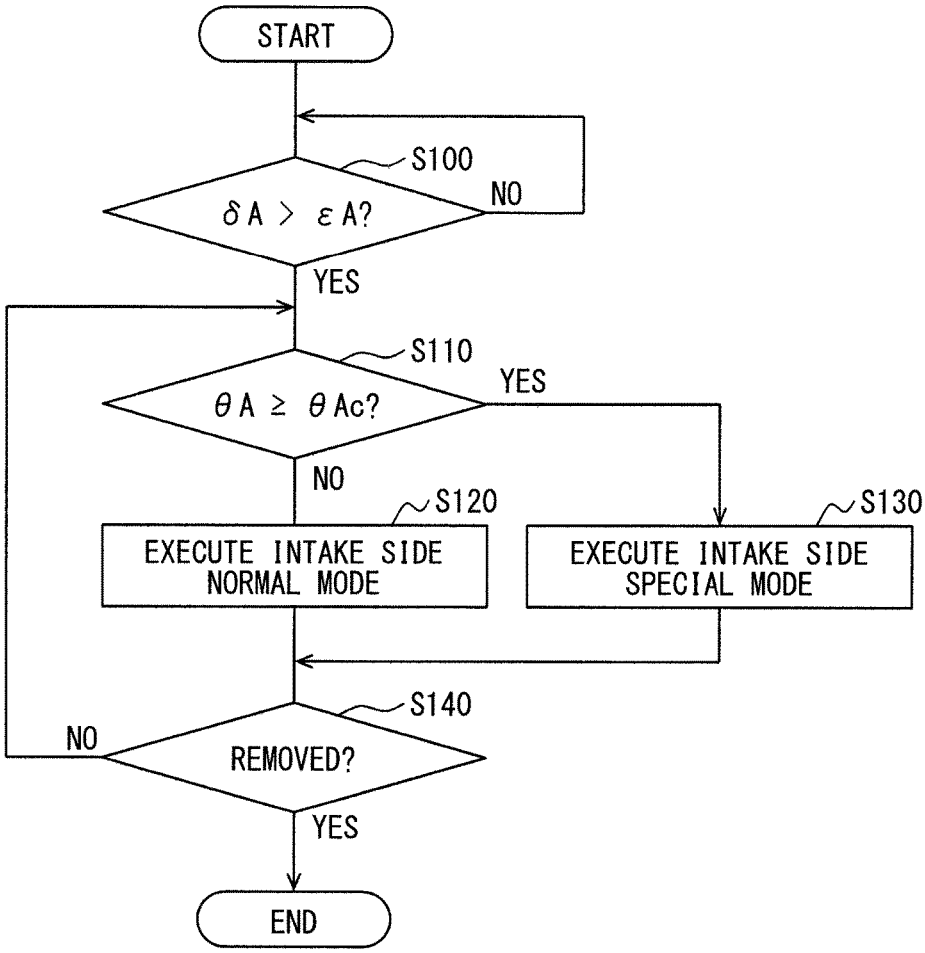
FIG. 7 is a flowchart showing a control operation of the intake valve system of the embodiment.
Figure 8:
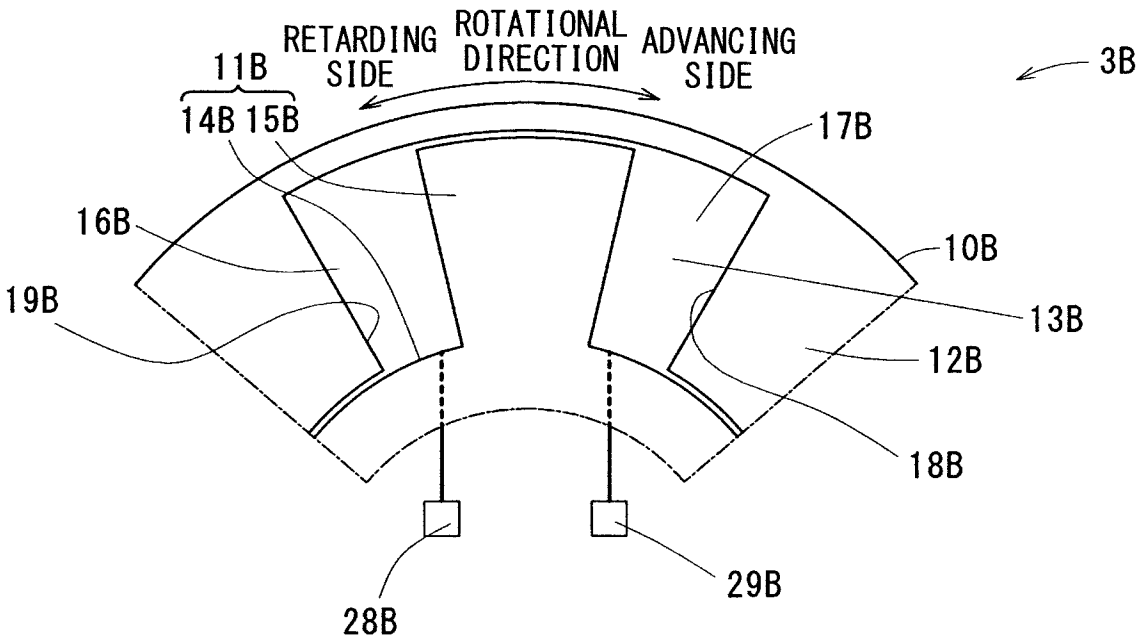
FIG. 8 is a descriptive diagram of a variable timing device of an exhaust valve system of the embodiment.
Figure 9:
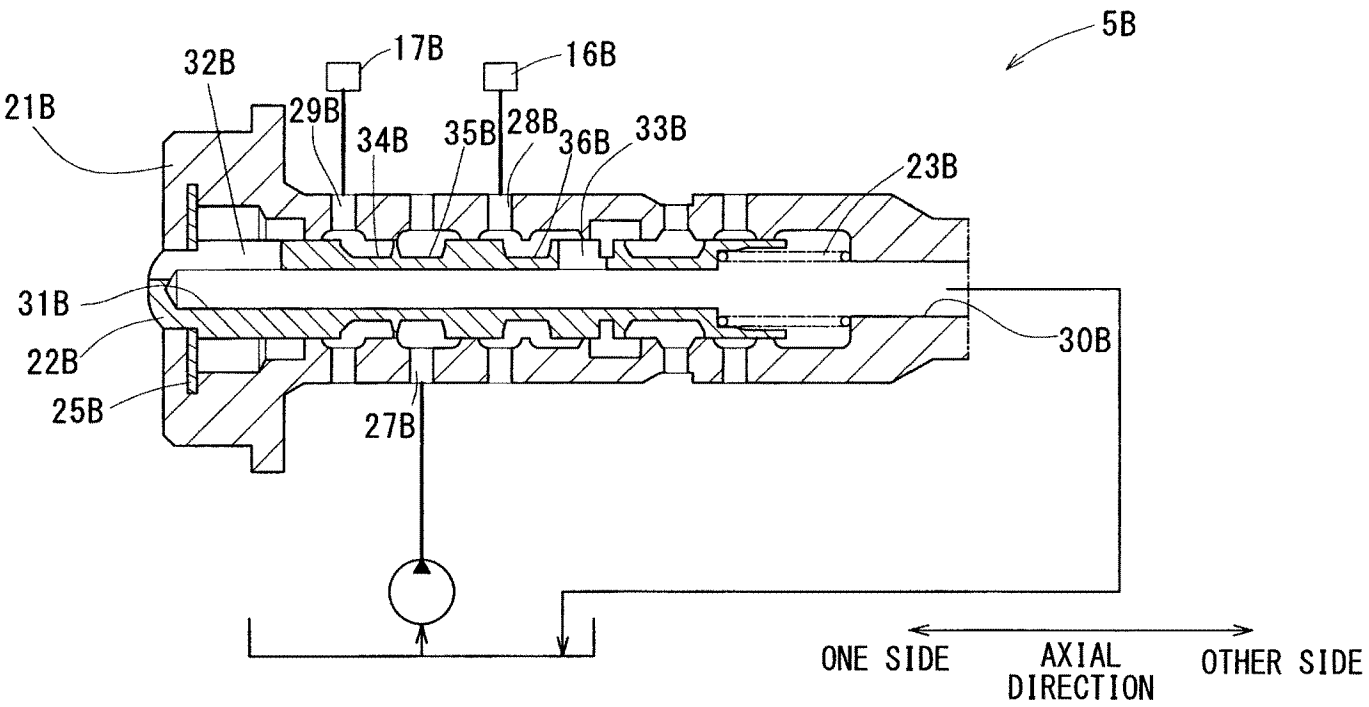
FIG. 9 is a descriptive diagram of an oil pressure supply device of the exhaust valve system of the embodiment.
Figure 10A:
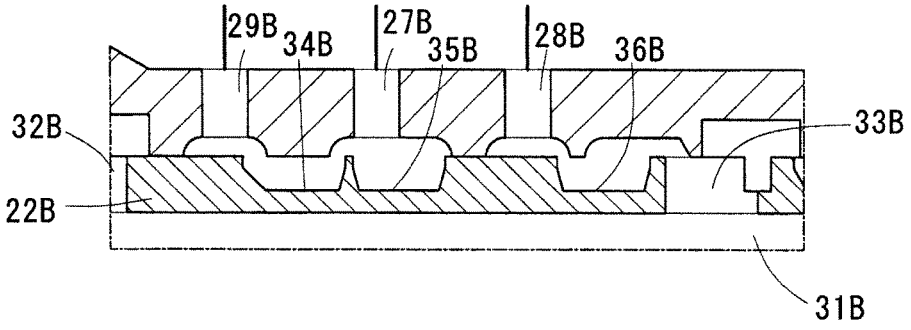
FIGS. 10A to 10C are diagrams showing various operational states of a spool of the exhaust valve system of the embodiment.
Figure 10B:
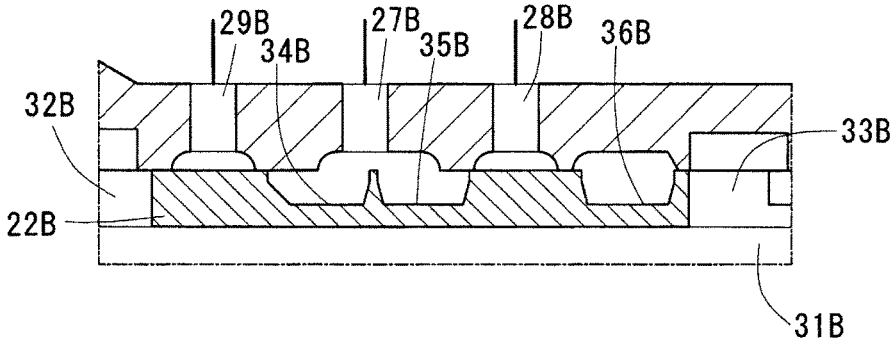
Figure 10C:
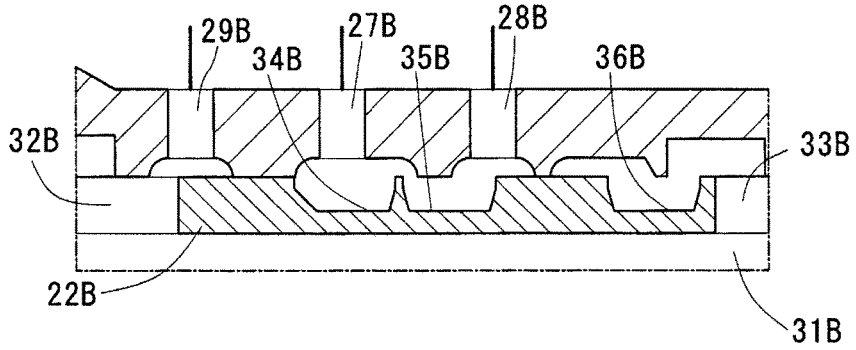

First, at step S100 of FIG. 7, it is determined whether the difference δA exceeds the permissible range εA. When it is determined that the difference δA exceeds the permissible range εA at step S100 (YES at step S100, see a time point t0 in FIG. 6A), the operation proceeds to step S110. In contrast, when it is determined that the difference δA does not exceed the permissible range εA at step S100 (NO at step S100), the determination of step S100 is repeated. The operation at step S100 corresponds to the function of the first determining unit 43.

Next, at step S110, it is determined whether the sensed value of the phase θA has reached the threshold value θAc.

When it is determined that the sensed value of the phase θA has not reached the threshold value θAc at step S110 (i.e., NO at step S110), the operation proceeds to step S120. At step S120, the intake side normal mode is executed (see a time period TNA starting from the time point t0 in FIG. 6B).

Here, it should be noted that instead of executing the intake side normal mode immediately after the time of making the NO determination at step S110, the intake side normal mode may be executed only after the NO determination at step S110 has continued for a predetermined time period for the purpose of eliminating an influence of a pulse noise. After the execution of the intake side normal mode at step S120, the operation proceeds to step S140.

When it is determined that the sensed value of the phase θA has reached the threshold value θAc at step S110 (i.e., YES at step S110, see a time point t1 in FIG. 6A), the operation proceeds to step S130. At step S130, the intake side special mode is executed (see a time period TSA starting from the time point t1 in FIG. 6B).

Here, it should be noted that instead of executing the intake side special mode immediately after the time of making the YES determination at step S110, the intake side special mode may be executed only after the YES determination at step S110 has continued for a predetermined time period for the purpose of eliminating the influence of the pulse noise. After the execution of the intake side special mode at S130, the operation proceeds to step S140. The operation at step S110 corresponds to the function of the second determining unit 45.

Next, at step S140, it is determined whether the foreign object has been removed.

When it is determined that the foreign object has been removed at step S140 (YES at step S140), the operation of the flowchart of FIG. 7 is terminated. In contrast, when it is determined that the foreign object has not been removed at step S140 (NO at step S140), the operation returns to step S110.

Here, it is possible to determine whether the foreign object has been removed by, for example, temporarily setting the amount ISA of electric power supplied to the electromagnetic solenoid 24A to zero (0) and then determining whether the phase θA is changed to the retarding side upon the temporarily setting of the amount ISA of electric power supplied to the electromagnetic solenoid 24A to zero (0).

Next, the control method for the exhaust valve system according to the present embodiment will be described with reference to FIGS. 12A to 13.

Figure 12A:
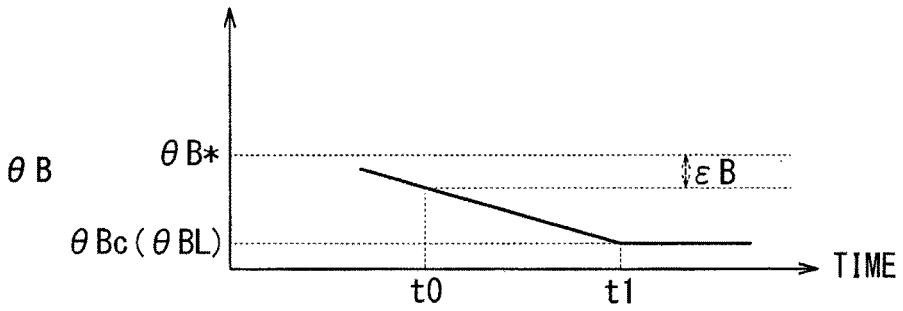
FIG. 12A is a diagram indicating a change in a phase with time in the exhaust valve system of the embodiment.
Figure 12B:
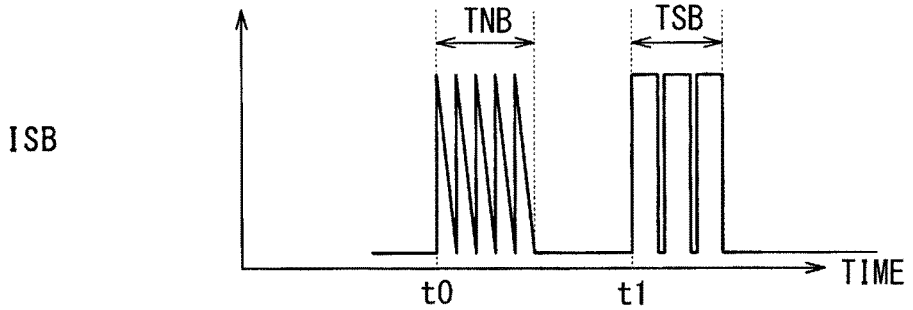
FIG. 12B is a diagram indicating a change in the amount of electric power supplied to an electromagnetic solenoid with time in the exhaust valve system of the embodiment.

In FIG. 12A, θB* is the target value of the phase θB. Furthermore, in FIG. 12B, TNB is an execution time period of the exhaust side normal mode, and TSB is an execution time period of the exhaust side special mode.

Figure 13:
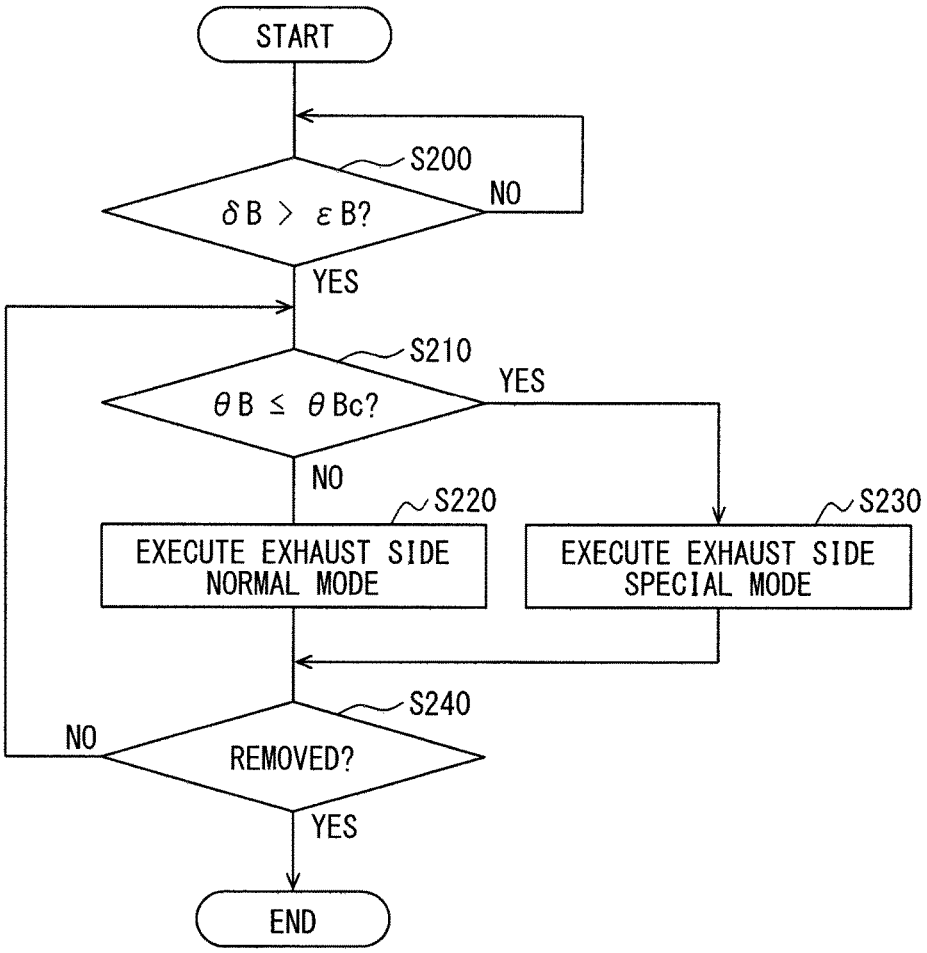
FIG. 13 is a flowchart showing a control operation of the exhaust valve system of the embodiment.

First, at step S200 of FIG. 13, it is determined whether the difference δB exceeds the permissible range εB. When it is determined that the difference δB exceeds the permissible range εB at step S200 (YES at step S200, see the time point t0 in FIG. 12A), the operation proceeds to step S210. In contrast, when it is determined that the difference δB does not exceed the permissible range εB at step S200 (NO at step S200), the determination of step S200 is repeated. The operation at step S200 corresponds to the function of the third determining unit 47.

Next, at step S210, it is determined whether the sensed value of the phase θB has reached the threshold value θBc. When it is determined that the sensed value of the phase θB has not reached the threshold value θBc at step S210 (i.e., NO at step S210), the operation proceeds to step S220. At step S220, the exhaust side normal mode is executed (see the time period TNB starting from the time point t0 in FIG. 12B).

Here, it should be noted that instead of executing the exhaust side normal mode immediately after the time of making the NO determination at step S210, the exhaust side normal mode may be executed only after the NO determination at step S210 has continued for a predetermined time period for the purpose of eliminating the influence of the pulse noise. After the execution of the exhaust side normal mode at step S220, the operation proceeds to step S240.

When it is determined that the sensed value of the phase θB has reached the threshold value θBc at step S210 (i.e., YES at step S210, see the time point t1 in FIG. 12A), the operation proceeds to step S230. At step S230, the exhaust side special mode is executed (see the time period TSB starting from the time point t1 in FIG. 12B).

Here, it should be noted that instead of executing the exhaust side special mode immediately after the time of making the YES determination at step S210, the exhaust side special mode may be executed only after the YES determination at step S210 has continued for a predetermined time period for the purpose of eliminating the influence of the pulse noise. After the execution of the exhaust side special mode at S220, the operation proceeds to step S240. The operation at step S210 corresponds to the function of the fourth determining unit 49.

Next, at step S240, it is determined whether the foreign object has been removed.

When it is determined that the foreign object has been removed at step S140 (YES at step S140), the operation of the flowchart of FIG. 7 is terminated. In contrast, when it is determined that the foreign object has not been removed at step S240 (NO at step S240), the operation returns to step S210.

Here, it is possible to determine whether the foreign object has been removed by, for example, temporarily setting the amount ISB of electric power supplied to the electromagnetic solenoid 24B to a maximum value and then determining whether the phase θB is changed to the advancing side upon the temporarily setting of the amount ISB of electric power supplied to the electromagnetic solenoid 24B to the maximum value.

Now, advantages of the embodiment will be described.

In the variable apparatus 1 of the present embodiment, the variable timing device 3A includes the advancing side limiting portion 18A that limits the rotation of the vane 15A toward the advancing side and thereby defines the limit of the variable range of the phase θB at the most advanced side.

The ECU 9 sets the permissible range εA for the difference δA between the sensed value of the phase 8A and the target value of the phase θA as well as the threshold value θAc for the sensed value of the phase θA. Furthermore, the ECU 9 includes the first determining unit 43 and the second determining unit 45. The first determining unit 43 determines whether the difference δA exceeds the permissible range εA. The second determining unit 45 determines whether the sensed value of the phase θA has reached the threshold value θAc after the first determining unit 43 determines that the difference δA exceeds the permissible range εA.

Furthermore, the ECU 9 has at least the two modes, which are used as the operational modes for controlling the electric power supply to the electromagnetic solenoid 24A in the case where the first determining unit 43 determines that the difference δA exceeds the permissible range εA.

One of these two modes is the intake side special mode that is used when the second determining unit 45 determines that the sensed value of the phase θA has reached the threshold value θAc. The other one of the two modes is the intake side normal mode that is used when the second determining unit 45 determines that the sensed value of the phase θA has not reached the threshold value θAc.

In the intake side special mode, the power supply to the electromagnetic solenoid 24A is controlled such that the opening degree of the advancing port 28A becomes larger than the opening degree of the advancing port 28A in the intake side normal mode.

Therefore, by using the intake side special mode, the opening degree of the advancing port 28A can be increased, and thereby the foreign object can be more reliably removed.

Furthermore, by providing the second determining unit 45, it is possible to limit the time period, in which the opening degree of the advancing port 28A is large.

Specifically, in the second determining unit 45, the intake side special mode is used when the sensed value of the phase θA exceeds the threshold value θAc. Therefore, the period of having the large opening degree of the advancing port 28A is limited to the period that is from the time point, at which the phase θA exceeds the threshold value θAc, to the time point, at which the phase θA reaches the most advanced phase value θAL of the variable range.

Therefore, even when the opening degree of the advancing port 28A is increased by using the intake side special mode, it is possible to limit occurrence of the unexpected sudden increase in the rotational speed of the internal combustion engine.

As a result, in the variable apparatus 1, the foreign object can be reliably removed while limiting the unexpected sudden increase in the rotational speed of the internal combustion engine.

In the variable apparatus 1 of the present embodiment, the threshold value θAc is the most advanced phase value θAL of the variable range of the phase θA.

Therefore, even when the opening degree of the advancing port 28A is increased by using the intake side special mode, the further advancing of the phase θA is prevented by the advancing side limiting portion 18A. Therefore, the unexpected sudden increase in the rotational speed of the internal combustion engine can be further limited.

Furthermore, in the variable apparatus 1 of the present embodiment, the ECU 9 controls the supply of the electric power to the electromagnetic solenoid 24A by outputting the command value for the amount ISA of electric power to the electromagnetic solenoid 24A. The waveform of the temporal change in the command value for the amount of electric power supplied to the electromagnetic solenoid 24A is the rectangular waveform in the intake side special mode, and the waveform of the temporal change in the command value for the amount of electric power supplied to the electromagnetic solenoid 24A is the triangular waveform in the intake side normal mode.

Thereby, for example, in the case where the command value for the amount of electric power supplied to the electromagnetic solenoid 24A is changed in a binary manner between zero (0) and the maximum value during the time of executing the mode, by setting the rectangular waveform in the intake side special mode and the triangular waveform in the intake side normal mode, the temporal average value of the opening degree in the intake side special mode can be easily increased in comparison to the temporal average value of the opening degree in the intake side normal mode.

In the variable apparatus 1 of the present embodiment, the variable timing device 3B includes the retarding side limiting portion 19B that limits the rotation of the vane 15B toward the retarding side and thereby defines the limit of the variable range of the phase θB at the most retarded side.

The ECU 9 sets the permissible range εB for the difference δB between the sensed value of the phase θB and the target value of the phase θB as well as the threshold value θBc for the sensed value of the phase θB. Furthermore, the ECU 9 includes the third determining unit 47 and the fourth determining unit 49. The third determining unit 47 determines whether the difference δB exceeds the permissible range εB. The fourth determining unit 49 determines whether the sensed value of the phase θB has reached the threshold value θBc after the third determining unit 47 determines that the difference 5B exceeds the permissible range εB.

Furthermore, the ECU 9 has at least the two modes, which are used as the operational modes for controlling the electric power supply to the electromagnetic solenoid 24B in the case where the third determining unit 47 determines that the difference δB exceeds the permissible range εB.

One of these two modes is the exhaust side special mode that is used when the fourth determining unit 49 determines that the sensed value of the phase θB has reached the threshold value θBc. The other one of the two modes is the exhaust side normal mode that is used when the fourth determining unit 49 determines that the sensed value of the phase θB has not reached the threshold value θBc.

In the exhaust side special mode, the power supply to the electromagnetic solenoid 24B is controlled such that the opening degree of the retarding port 29B becomes larger than the opening degree of the retarding port 29B in the exhaust side normal mode.

Therefore, by using the exhaust side special mode, the opening degree of the retarding port 29B can be increased, and thereby the foreign object can be more reliably removed.

Furthermore, by providing the fourth determining unit 49, it is possible to limit the time period, in which the opening degree of the retarding port 29B is large.

Specifically, in the fourth determining unit 49, the exhaust side special mode is used when the sensed value of the phase θB exceeds the threshold value θBc. Therefore, the period of having the large opening degree of the retarding port 29B is limited to the period that is from the time point, at which the phase θB exceeds the threshold value θBc, to the time point, at which the phase θB reaches the most retarded phase value θBL of the variable range.

Therefore, even when the opening degree of the retarding port 29B is increased by using the exhaust side special mode, it is possible to limit occurrence of the unexpected sudden increase in the rotational speed of the internal combustion engine.

As a result, in the variable apparatus 1, the foreign object can be reliably removed while limiting the unexpected sudden increase in the rotational speed of the internal combustion engine.

In the variable apparatus 1 of the present embodiment, the threshold value θBc is the most retarded phase value θBL of the variable range of the phase θB.

Therefore, even when the opening degree of the retarding port 29B is increased by using the exhaust side special mode, the further advancing of the phase θB is prevented by the retarding side limiting portion 19B. Therefore, the unexpected sudden increase in the rotational speed of the internal combustion engine can be further limited.

Furthermore, in the variable apparatus 1 of the present embodiment, the ECU 9 controls the supply of the electric power to the electromagnetic solenoid 24B by outputting the command value for the amount ISB of electric power to the electromagnetic solenoid 24B. The waveform of the temporal change in the command value for the amount of electric power supplied to the electromagnetic solenoid 24B is the rectangular waveform in the exhaust side special mode, and the waveform of the temporal change in the command value for the amount of electric power supplied to the electromagnetic solenoid 24B is the triangular waveform in the exhaust side normal mode.

Thereby, for example, in the case where the command value for the amount of electric power supplied to the electromagnetic solenoid 24B is changed in a binary manner between zero (0) and the maximum value during the time of executing the mode, by setting the rectangular waveform in the exhaust side special mode and the triangular waveform in the exhaust side normal mode, the temporal average value of the opening degree in the intake side special mode can be easily increased in comparison to the temporal average value of the opening degree in the exhaust side normal mode.

Various modifications of the above embodiment can be made without departing the scope of the present disclosure.

In the above embodiment, the most advanced phase value θAL is set as the threshold value θAc. Alternatively, the threshold value θAc may be set on the retarding side of the most advanced phase value θAL (see FIGS. 14A and 14B).

In this case, based on, for example, a result of experiments, a range, in which the influence of the unexpected sudden increase in the rotational speed of the internal combustion engine is small even when the phase is advanced from the threshold value θAc, may be obtained in advance to set the threshold value θAc.

Figure 14A:
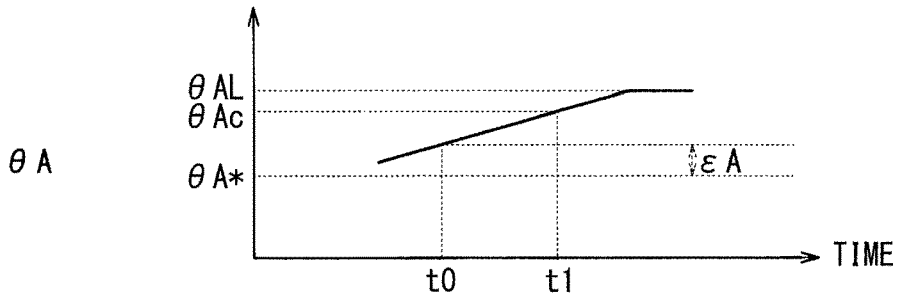
FIG. 14A is a diagram indicating a change in a phase with time in an intake valve system in a modification of the embodiment.
Figure 14B:
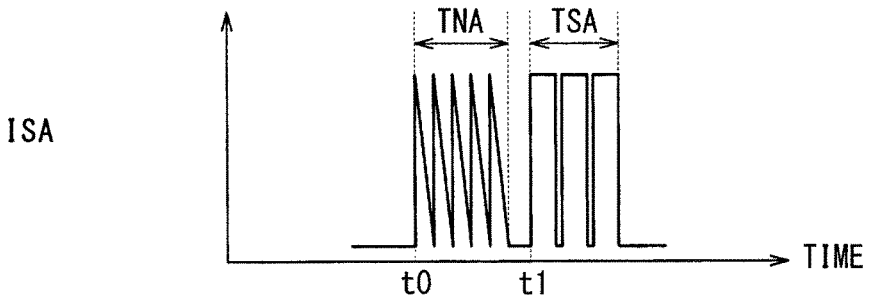
FIG. 14B is a diagram indicating a change in the amount of electric power supplied to an electromagnetic solenoid with time in the intake valve system in the modification of the embodiment.

In this way, the phase range, in which the intake side special mode can be executed, can be increased, and the range, in which the opening degree of the advancing port 28A can be made large, can be increased. Thereby, the removal of the foreign object can be more reliably executed. Furthermore, as shown in FIGS. 14A and 14B, the intake side special mode can be executed before the phase θA reaches the most advanced phase value θAL. Therefore, the removal of the foreign object can be completed in the earlier stage.

The phase can be oscillated relative to the target value θA*. At or around the most advanced phase value θAL, the vane 15A of the rotor 11A may possibly repeatedly collide against the advancing side limiting portion 18A. Here, in a case where an extent of oscillation of the phase θA relative to the target value θA* of the phase (θA) on the advancing side is defined as an amplitude aA, it is desirable that the threshold value θAc is set between the boundary value θAL of the variable range of the phase θA, which is set on the most advanced side, and an amplitude value θAa, which is displaced from the boundary value θAL on the retarding side by the amplitude aA.

The amplitude aA may be obtained in advance through, for example, experiments.

Figure 15:
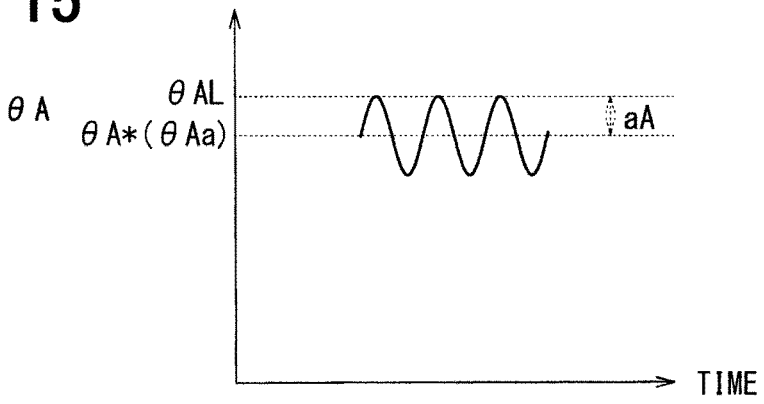
FIG. 15 is a descriptive diagram for describing an amplitude in the intake valve system in the modification of the embodiment.

In this way, in the case where there is a high possibility of that the vane 15A repeatedly collides against the advancing side limiting portion 18A, the vane 15A can be forcefully urged against the advancing side limiting portion 18A to limit the occurrence of repeated collisions of the vane 15A against the advancing side limiting portion 18A, and thereby wearing of the advancing side limiting portion 18A caused by the collisions of the vane 15A can be limited (see FIG. 15).

Figure 16A:
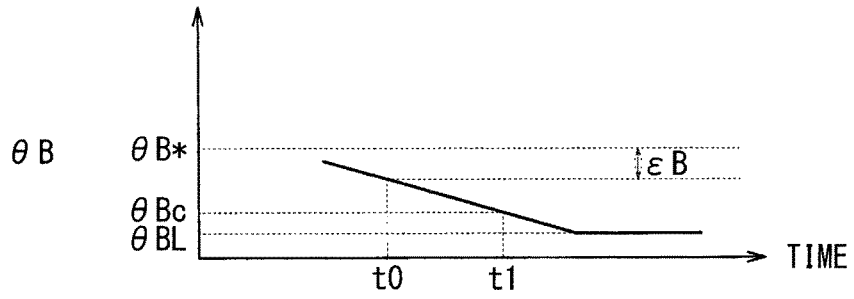
FIG. 16A is a diagram indicating a change in a phase with time in an exhaust valve system in the modification of the embodiment.
Figure 16B:
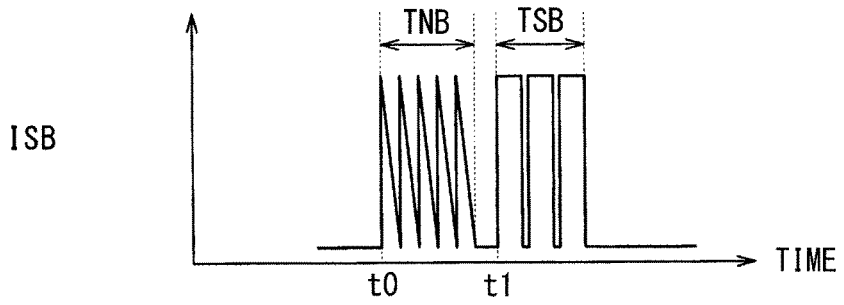
FIG. 16B is a diagram indicating a change in the amount of electric power supplied to an electromagnetic solenoid with time in the exhaust valve system of the modification of the embodiment.

Similarly, with reference to FIGS. 16A and 16B, the threshold value θBc may be set on the advancing side of the most advanced phase value θBL.

In this way, the phase range, in which the exhaust side special mode can be executed, can be increased, and the range, in which the opening degree of the retarding port 29B can be made large, can be increased. Thereby, the removal of the foreign object can be more reliably executed.

Furthermore, as shown in FIGS. 16A and 16B, the exhaust side special mode can be executed before the phase θB reaches the most retarded phase value θBL. Therefore, the removal of the foreign object can be completed in the earlier stage.

Figure 17:
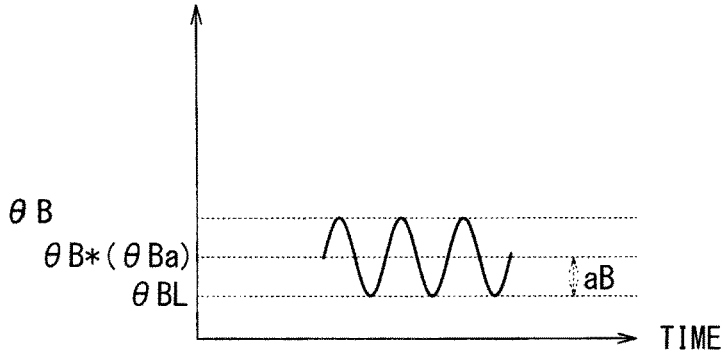
FIG. 17 is a descriptive diagram for describing an amplitude in the exhaust valve system in the modification of the embodiment.

Here, similar to the intake valve system, there would be a case where the phase θB oscillates relative to the target value θB*. In a case where an amplitude of the oscillation of the phase θB relative to the target value θB*, which occurs on the advancing side, is defined as an amplitude aB, it is desirable that the threshold value θBc is set between the boundary value θBL of the variable range of the phase θB, which is set on the most retarded side, and an amplitude value θBa, which is displaced from the boundary value θBL on the advancing side by the amplitude aB (see FIG. 17).

Furthermore, the normal mode is executed before the special mode in the above embodiment. However, since the special mode and the normal mode may be individually executed, it is not absolutely necessary to execute the normal mode before the special mode. Therefore, the special mode may be solely executed.

Furthermore, the number of increases or decreases of the electric current in the normal mode and the number of increases or decreases of the electric current in the special mode are not limited to the above described ones. The number of increase(s) or decrease(s) may be one or may be set to a different number(s).

What is claimed is:

1. A variable valve timing apparatus that advances or retards opening timing and closing timing of an intake valve of an internal combustion engine through use of an oil pressure, the variable valve timing apparatus comprising:

a variable timing device that rotates a vane toward an advancing side through application of the oil pressure to the vane to advance the opening timing and closing timing of the intake valve;

an oil pressure supply device that includes:

a supply port that supplies the oil pressure to the variable timing device;

a valve element that increases or decreases an opening degree of the supply port; and an electromagnetic solenoid that drives the valve element, wherein the opening degree of the supply port is increased or decreased by the valve element to adjust the supply of the oil pressure to the variable timing device when supply of an electric power to the electromagnetic solenoid is controlled;

a phase sensing device that senses a value of a phase, which indicates a degree of advancing of the opening timing and closing timing; and a control device that computes a target value of the phase based on an operational state of the internal combustion engine and controls the supply of the electric power to the electromagnetic solenoid based on a result of a comparison between the sensed value of the phase, which is obtained from the phase sensing device, and the target value of the phase, wherein:

the variable timing device includes a limiting portion that limits rotation of the vane toward the advancing side and thereby defines a limit of a variable range of the phase at a most advanced side;

the control device sets:

a permissible range of a difference between the sensed value of the phase and the target value of the phase; and a threshold value of the sensed value of the phase;

the control device includes:

a first determining unit that determines whether the difference exceeds the permissible range; and a second determining unit that determines whether the sensed value of the phase reaches the threshold value when the first determining unit determines that the difference exceeds the permissible range;

the control device has at least two modes as control modes of the electric power supply to the electromagnetic solenoid, which are used when the first determining unit determines that the difference exceeds the permissible range;

one of the at least two modes is a special mode that is used when the second determining unit determines that the sensed value of the phase reaches the threshold value;

another one of the at least two modes is a normal mode that is used when the second determining unit determines that the sensed value of the phase does not reach the threshold value; and in the special mode, the control device controls the supply of the electric power to the electromagnetic solenoid in such a manner that the opening degree of the supply port is larger than the opening degree of the supply port in the normal mode.

2. The variable valve timing apparatus according to claim 1, wherein the threshold value is a boundary value of the variable range of the phase on the most advanced side.

3. The variable valve timing apparatus according to claim 1, wherein:

an extent of oscillation of the phase relative to the target value of the phase on the advancing side is defined as an amplitude; and the threshold value is set between a boundary value of the variable range of the phase, which is on the most advanced side, and an amplitude value, which is displaced from the boundary value on a retarding side by the amplitude.

4. The variable valve timing apparatus according to claim 1, wherein:

the control device controls the supply of the electric power to the electromagnetic solenoid by outputting a command value for an amount of electric power supplied to the electromagnetic solenoid;

a waveform of a temporal change in the command value for the amount of electric power in the special mode is a rectangular waveform; and a waveform of a temporal change in the command value for the amount of electric power in the normal mode is a triangular waveform.

5. A variable valve timing apparatus that advances or retards opening timing and closing timing of an exhaust valve of an internal combustion engine through use of an oil pressure, the variable valve timing apparatus comprising:

a variable timing device that rotates a vane toward a retarding side through application of the oil pressure to the vane to retard the opening timing and closing timing of the exhaust valve;

an oil pressure supply device that includes:

a supply port that supplies the oil pressure to the variable timing device;

a valve element that increases or decreases an opening degree of the supply port; and an electromagnetic solenoid that drives the valve element, wherein the opening degree of the supply port is increased or decreased by the valve element to adjust the supply of the oil pressure to the variable timing device when supply of an electric power to the electromagnetic solenoid is controlled;

a phase sensing device that senses a value of a phase, which indicates a degree of retarding of the opening timing and closing timing; and a control device that computes a target value of the phase based on an operational state of the internal combustion engine and controls the supply of the electric power to the electromagnetic solenoid based on a result of a comparison between the sensed value of the phase, which is obtained from the phase sensing device, and the target value of the phase, wherein:

the variable timing device includes a limiting portion that limits rotation of the vane toward the retarding side and thereby defines a limit of a variable range of the phase at a most retarded side;

the control device sets:

a permissible range of a difference between the sensed value of the phase and the target value of the phase; and a threshold value of the sensed value of the phase;

the control device includes:

a first determining unit that determines whether the difference exceeds the permissible range; and a second determining unit that determines whether the sensed value of the phase reaches the threshold value when the first determining unit determines that the difference exceeds the permissible range;

the control device has at least two modes as control modes of the electric power supply to the electromagnetic solenoid, which are used when the first determining unit determines that the difference exceeds the permissible range;

one of the at least two modes is a special mode that is used when the second determining unit determines that the sensed value of the phase reaches the threshold value;

another one of the at least two modes is a normal mode that is used when the second determining unit determines that the sensed value of the phase does not reach the threshold value; and in the special mode, the control device controls the supply of the electric power to the electromagnetic solenoid in such a manner that the opening degree of the supply port is larger than the opening degree of the supply port in the normal mode.

6. The variable valve timing apparatus according to claim 5, wherein the threshold value is a boundary value of the variable range of the phase on the most retarded side.

7. The variable valve timing apparatus according to claim 5, wherein:

an extent of oscillation of the phase relative to the target value of the phase on the retarding side is defined as an amplitude; and the threshold value is set between a boundary value of the variable range of the phase, which is on the most retarded side, and an amplitude value, which is displaced from the boundary value on an advancing side by the amplitude.

8. The variable valve timing apparatus according to claim 5, wherein:

the control device controls the supply of the electric power to the electromagnetic solenoid by outputting a command value for an amount of electric power supplied to the electromagnetic solenoid;

a waveform of a temporal change in the command value for the amount of electric power in the special mode is a rectangular waveform; and a waveform of a temporal change in the command value for the amount of electric power in the normal mode is a triangular waveform.

9. A variable valve timing apparatus that advances or retards opening timing and closing timing of an intake valve of an internal combustion engine through use of an oil pressure, the variable valve timing apparatus comprising:

a variable timing device including a housing and a rotor, the variable timing device being configured to rotate a vane toward an advancing side through application of the oil pressure to the vane to advance the opening timing and closing timing of the intake valve;

an oil pressure supply device that includes:

a supply port that supplies the oil pressure to the variable timing device;

a valve element that increases or decreases an opening degree of the supply port; and an electromagnetic solenoid that drives the valve element, wherein the opening degree of the supply port is increased or decreased by the valve element to adjust the supply of the oil pressure to the variable timing device when supply of an electric power to the electromagnetic solenoid is controlled;

a phase sensor configured to sense a value of a phase, which indicates a degree of advancing of the opening timing and closing timing; and a controller configured to compute a target value of the phase based on an operational state of the internal combustion engine and control the supply of the electric power to the electromagnetic solenoid based on a result of a comparison between the sensed value of the phase, which is obtained from the phase sensor, and the target value of the phase, wherein:

a wall of the housing limits rotation of the vane toward the advancing side and thereby defines a limit of a variable range of the phase at a most advanced side;

the controller is configured to set:

a permissible range of a difference between the sensed value of the phase and the target value of the phase; and a threshold value of the sensed value of the phase;

the controller is configured to:

make a first determination that determines whether the difference exceeds the permissible range; and make a second determination that determines whether the sensed value of the phase reaches the threshold value when the first determination determines that the difference exceeds the permissible range;

the controller has at least two modes as control modes of the electric power supply to the electromagnetic solenoid, which are used when the first determination determines that the difference exceeds the permissible range;

one of the at least two modes is a special mode that is used when the second determination determines that the sensed value of the phase reaches the threshold value;

another one of the at least two modes is a normal mode that is used when the second determination determines that the sensed value of the phase does not reach the threshold value; and in the special mode, the controller controls the supply of the electric power to the electromagnetic solenoid in such a manner that the opening degree of the supply port is larger than the opening degree of the supply port in the normal mode.

10. The variable valve timing apparatus according to claim 9, wherein the threshold value is a boundary value of the variable range of the phase on the most advanced side.

11. The variable valve timing apparatus according to claim 9, wherein:

an extent of oscillation of the phase relative to the target value of the phase on the advancing side is defined as an amplitude; and the threshold value is set between a boundary value of the variable range of the phase, which is on the most advanced side, and an amplitude value, which is displaced from the boundary value on a retarding side by the amplitude.

12. The variable valve timing apparatus according to claim 9, wherein:

the controller is configured to control the supply of the electric power to the electromagnetic solenoid by outputting a command value for an amount of electric power supplied to the electromagnetic solenoid;

a waveform of a temporal change in the command value for the amount of electric power in the special mode is a rectangular waveform; and a waveform of a temporal change in the command value for the amount of electric power in the normal mode is a triangular waveform.

13. A variable valve timing apparatus that advances or retards opening timing and closing timing of an exhaust valve of an internal combustion engine through use of an oil pressure, the variable valve timing apparatus comprising:

a variable timing device including a housing and a rotor, the variable timing device being configured to rotate a vane toward a retarding side through application of the oil pressure to the vane to retard the opening timing and closing timing of the exhaust valve;

an oil pressure supply device that includes:

a supply port that supplies the oil pressure to the variable timing device;

a valve element that increases or decreases an opening degree of the supply port; and an electromagnetic solenoid that drives the valve element, wherein the opening degree of the supply port is increased or decreased by the valve element to adjust the supply of the oil pressure to the variable timing device when supply of an electric power to the electromagnetic solenoid is controlled;

a phase sensor configured to sense a value of a phase, which indicates a degree of retarding of the opening timing and closing timing; and a controller configured to compute a target value of the phase based on an operational state of the internal combustion engine and control the supply of the electric power to the electromagnetic solenoid based on a result of a comparison between the sensed value of the phase, which is obtained from the phase sensor, and the target value of the phase, wherein:

a wall of the housing limits rotation of the vane toward the retarding side and thereby defines a limit of a variable range of the phase at a most retarded side;

the controller is configured to set:

a permissible range of a difference between the sensed value of the phase and the target value of the phase; and a threshold value of the sensed value of the phase;

the controller is configured to:

make a first determination that determines whether the difference exceeds the permissible range; and make a second determination that determines whether the sensed value of the phase reaches the threshold value when the first determination determines that the difference exceeds the permissible range;

the controller has at least two modes as control modes of the electric power supply to the electromagnetic solenoid, which are used when the first determination determines that the difference exceeds the permissible range;

one of the at least two modes is a special mode that is used when the second determination determines that the sensed value of the phase reaches the threshold value;

another one of the at least two modes is a normal mode that is used when the second determination determines that the sensed value of the phase does not reach the threshold value; and in the special mode, the controller controls the supply of the electric power to the electromagnetic solenoid in such a manner that the opening degree of the supply port is larger than the opening degree of the supply port in the normal mode.

14. The variable valve timing apparatus according to claim 13, wherein the threshold value is a boundary value of the variable range of the phase on the most retarded side.

15. The variable valve timing apparatus according to claim 13, wherein:

an extent of oscillation of the phase relative to the target value of the phase on the retarding side is defined as an amplitude; and the threshold value is set between a boundary value of the variable range of the phase, which is on the most retarded side, and an amplitude value, which is displaced from the boundary value on an advancing side by the amplitude.

16. The variable valve timing apparatus according to claim 13, wherein:

the controller is configured to control the supply of the electric power to the electromagnetic solenoid by outputting a command value for an amount of electric power supplied to the electromagnetic solenoid;

a waveform of a temporal change in the command value for the amount of electric power in the special mode is a rectangular waveform; and a waveform of a temporal change in the command value for the amount of electric power in the normal mode is a triangular waveform.

* * * * *